United States Patent [19]

Funk

[11] 4,366,757

[45] Jan. 4, 1983

[54] ACTUATING AND LOCKING MEANS FOR THE HOPPER DOORS OF A RAILROAD HOPPER CAR

[75] Inventor: Stanley Funk, Hamilton, Ohio

[73] Assignee: Ortner Freight Car Company, Milford, Ohio

[21] Appl. No.: 208,576

[22] Filed: Nov. 20, 1980

[51] Int. Cl.[3] ..... B61D 7/018

[52] U.S. Cl. ..... 105/248; 105/250; 105/253; 105/284; 298/35 R; 414/388

[58] Field of Search ..... 105/248–253, 105/283, 284, 280; 414/388; 298/35 R, 35 M, 29, 30, 31, 32, 33, 34

[56] References Cited

U.S. PATENT DOCUMENTS

| | | | |
|---|---|---|---|
| 1,625,089 | 4/1927 | Morey | 105/251 |
| 2,893,327 | 7/1959 | Lunde | 105/251 |
| 3,167,026 | 1/1965 | Kemp | 105/250 |
| 3,187,684 | 6/1965 | Ortner | 105/248 |
| 3,187,685 | 6/1965 | Floehr | 105/253 |
| 3,192,876 | 7/1965 | Ortner | 105/284 |
| 3,256,836 | 6/1966 | Floehr | 105/253 X |
| 3,316,859 | 5/1967 | Floehr | 105/253 |
| 3,405,655 | 10/1968 | Dorey | 105/250 |
| 3,483,830 | 12/1969 | McGrath | 105/283 X |
| 3,596,609 | 8/1971 | Ortner | 105/253 X |
| 3,776,142 | 12/1973 | Molloy et al. | 105/253 |
| 4,106,813 | 8/1978 | Goodbary | 298/35 M |

*Primary Examiner*—Joseph F. Peters, Jr.
*Assistant Examiner*—M. J. Hill
*Attorney, Agent, or Firm*—Frost & Jacobs

[57] ABSTRACT

An apparatus for actuating and locking each pair of hopper doors of a railroad hopper car of the type having a plurality of hopper doors arranged in opposed pairs and extending transversely of the hopper car center sill. Each door actuating and locking apparatus for each opposed pair of hopper doors comprises a shaft assembly extending transversely of the hopper car between its respective opposed pair of hopper doors and through the hopper car center sill and the inner and outer hopper sheets for those hopper doors. That portion of the shaft assembly located within the center sill has an L-shaped lever structure non-rotatively mounted thereon. The lever structure is connected by links to the hopper doors of its respective pair. Either end of the shaft assembly can be engaged externally of the hopper car by an approriate tool to rotate the shaft assembly and its lever structure between a door open position and an over-center, door-closed and locked position.

19 Claims, 20 Drawing Figures

ACTUATING AND LOCKING MEANS FOR THE HOPPER DOORS OF A RAILROAD HOPPER CAR

TECHNICAL FIELD

The invention relates to a door actuating and locking means for the hopper doors of a railroad hopper car, and more particularly to such a hopper door actuating and locking means which is manually operable from either side of the hopper car.

BACKGROUND ART

In recent years railroad hopper cars have been developed of increased size and of greatly increased capacity. These hopper cars are so constructed that the entire car body comprises essentially a single hopper closed across its bottom by coacting opposed pairs of hopper doors arranged transversely of the longitudinal axis or the center sill of the car throughout substantially the full length of the car. Thus, the sets of doors, when opened, define in effect a single discharge orifice interrupted only by bracing members of minimal size which are configured to assist in discharging the load as it drops downwardly upon the opening of the hopper doors. Such newer and more advanced types of hopper cars and automatic means for opening and closing the hopper doors are taught, for example, in U.S. Pat. Nos. 3,187,684 and 3,596,609.

There are circumstances, however, which make it desirable to provide for the manual opening and closing of the hopper doors of such cars in essentially the same manner as conventional hopper car doors are opened and closed. In conventional hopper cars latch means are provided, usually at the opposite ends of each hopper door, to secure it in its closed position. When these latches are released by workmen on both sides of the hopper car, the door will swing downwardly to its open position under its own weight and under the weight of the lading pressing against the hopper door. When the load has been discharged, the hopper door must be moved manually to its closed position and re-latched on both sides.

Such a manual door opening and closing procedure has a number of inherent problems. For example, even in a conventional hopper car, each hopper door is of substantial size and is quite heavy, with the result that considerable physical force is required to swing the hopper door from its open to its closed position. This difficulty has been magnified greatly in the newer, larger and more advanced types of hopper cars under consideration herein, since such cars are considerably larger with the result that the hopper doors are also larger and heavier. This particular problem has been overcome by providing spring loaded devices in association with the hopper doors which serve not only as spring loaded stops for the open position of the hopper doors, but also as means to assist in the operation of closing the hopper doors. Such devices are taught, for example in U.S. Pat. Nos. 3,192,876 and 3,776,142.

Another problem with a manual door opening operation lies in the fact that a worker is required on both sides of the hopper car to latch and unlatch the hopper doors. Yet another disadvantage is found in the fact that the hopper doors and their hinge means are subjected to uneven wrenching or twisting forces if the latches on either end of the doors are not released simultaneously. Furthermore, such doors are sometimes latched on one side only, the other side being forgotten or inaccessable.

These problems again are magnified in the newer and more advanced types of hopper cars.

Prior art workers have devised manual door actuating means for that type of hopper car which does not have a center sill extending throughout its length. Such door actuating means are taught in U.S. Pat. Nos. 3,167,026 and 3,483,830. These door actuating means are not applicable, however, to hopper cars of the type having a center sill such as the hopper cars taught in the above mentioned U.S. Pat. Nos. 3,187,684 and 3,596,609. Prior art workers have also devised manual door actuating means, operable from both sides of the car, for hopper cars having center sills. The door actuating means, however, are such that an actuating means must be provided for each hopper door.

The present invention is directed to the provision of a manually operable door actuating and locking means for each opposed pair of hopper doors of hopper cars of the general type taught in the above mentioned U.S. Pat. Nos. 3,187,684 and 3,596,609, wherein each hopper door is provided with a spring loaded assist device of any appropriate type such as that taught in the above mentioned U.S. Pat. Nos. 3,192,876 or 3,776,142. The door actuating and locking means of the present invention is manually operable from either side of the hopper car by a single workman. In the operation of the hopper door actuating and locking means, both hopper doors of the cooperating, opposed pair are unlatched simultaneously and each door of the pair is free of twisting or wrenching forces. As used herein and in the claims, the term "manually operable", as applied to the door actuating and locking means of the present invention, is intended to refer to an actuating and locking means operable by a workman provided with an appropriate hand tool such as a pry bar or the like, as opposed to fully automatic systems of the type taught in the above mentioned U.S. Pat. Nos. 3,187,684 and 3,596,609.

DISCLOSURE OF THE INVENTION

According to the invention there is provided a door actuating and locking means for each pair of hopper doors of a railroad hopper car of the type having a center sill extending longitudinally thereof and having a plurality of hopper doors arranged in opposed pairs and extending transversely of the hopper car center sill. The hopper doors of each pair are swingable between a downwardly depending open position and a closed position wherein their bottom edges meet in abutting relationship. Each hopper door of the pair comprises two interconnected panels, these panels being located to either side of the hopper car center sill. Each panel cooperates with inner and an outer hopper sheets on its respective side of the center sill.

Each door actuating and locking means for each cooperating, opposed pair of hopper doors comprises a shaft assembly extending transversely of the hopper car between its respective opposed pair of hopper doors and through the center sill, the inner hopper sheets and the outer hopper sheets for those hopper doors. The ends of the shaft assembly extend beyond the outer hopper sheets at either side of the hopper car. That portion of the shaft assembly located within the center sill has a L-shaped lever structure non-rotatively mounted on the shaft assembly. The L-shaped lever structure provides first and second pairs of legs, the legs of each pair being in parallel spaced relationship. Each of the legs of the first pair has a link pivotally affixed at one end to the legs and pivotally attached at its other end to a first hopper door of the pair thereof. The second pair of legs has a single link pivotally attached at one end thereto and therebetween, the other end of the single link being pivotally attached to the other hopper door of the pair thereof.

The L-shaped lever structure is rotatable by the shaft assembly between a first over-center position wherein the hopper doors connected thereto by the links are in their closed position, and a second position wherein the hopper doors of the pair are in their open position. Since the first position of the L-shaped lever structure is an over-center position, it will be understood that the hopper doors will thus be locked in their closed position. It will further be understood that to rotate the L-shaped lever structure from its first or hopper door-closed position to its second or hopper door-open position, it is only necessary to rotate the shaft assembly by an amount sufficient to cause the L-shaped lever structure to pass through its over-center position, whereupon continued rotation of the L-shaped lever structure to its hopper door-open position will be caused by the weight of the hopper doors themselves and the car load bearing thereon.

Means are provided on the exposed ends of the shaft assembly (to either side of the hopper car) to enable a single workman on either side of the hopper car to engage the shaft assembly end with an appropriate tool to cause rotation thereof between the hopper door-open and hopper door-closed positions of the L-shaped lever structure.

BRIEF DESCRIPTION OF THE DRAWINGS

FIG. 16 is a fragmentary elevational view of one end of the shaft assembly.

DETAILED DESCRIPTION OF THE INVENTION

Figure 1:
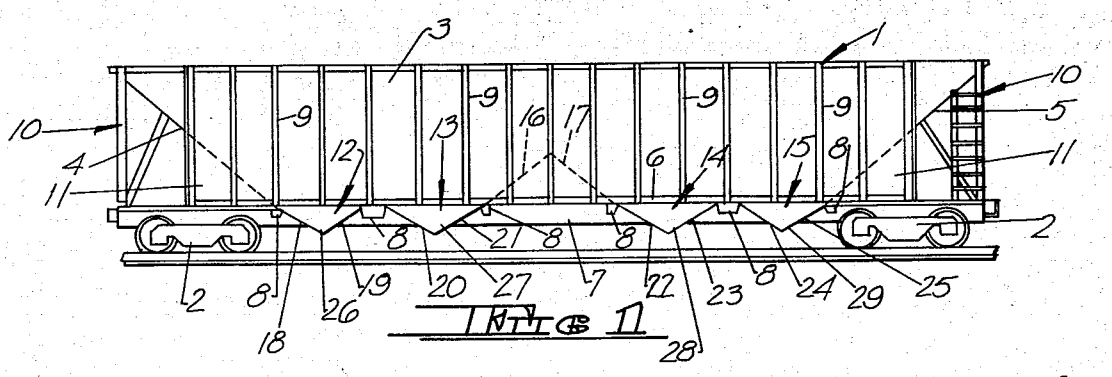
FIG. 1 is an elevational view of an exemplary hopper car of the type to which the door actuating and locking means of the present invention is applicable.

As indicated above, the present invention is applicable to hopper cars of the general type shown in the above mentioned U.S. Pat. Nos. 3,187,684 and 3,596,609. Such a hopper car is illustrated in FIG. 1. The hopper car comprises an elongated body generally indicated at 1 mounted on conventional trucks 2. The body 1 comprises vertical sides, one of which is shown at 3 with inclined end walls or slope sheets 4 and 5.

The hopper car body 1 is provided with a base framework, comprising elongated sides frame members or side sills (one of which is shown at 6), a longitudinally extending center sill 7 of inverted U-shaped cross section (see also FIG. 5) and a plurality of additional frame members 8 extending transversely of the car body from the center sill 7 to the side sills.

It will be understood by one skilled in the art that the ends of the car frame are provided with suitable bracing members (not shown). The side 3 of the hopper car has a plurality of vertical braces 9 which extend upwardly from side sill 6. The side of the hopper car not shown is provided with a similar set of vertical braces extending upwardly from its side sill. The ends of the car body also have vertical brace members, generally indicated at 10. The slope sheets 4 and 5 are additionally supported by a plurality of triangular braces 11 extending upwardly from the base frame of the car body to the slope sheets.

It will be evident from FIG. 1 that the hopper car is provided with four chutes generally indicated at 12 through 15. The centermost chutes 13 and 14 are separated by small, oppositely slanted slope sheets 16 and 17. The pair of chutes 12 and 13 are separated from each other by one of the transverse braces 8. The pair of chutes 14 and 15 are similarly separated. The transverse braces 8 may be provided with hoods 8*a* of inverted V-shaped cross section (see FIG. 2) which not only act as additional transverse supports, but also break up the car load and guide it during the discharge operation. In a hopper car having five chutes, the chutes are all separated by transverse braces 8, slope sheets 16 and 17 being eliminated. For additional structural support, the inside of the hopper car body 1 may be provided with a plurality of struts (not shown) extending upwardly and outwardly from the hoods 8*a* to the car sides.

Each of the chutes is provided with a pair of opposed hopper doors. Thus, in FIG. 1, chute 12 is provided with a pair of hopper doors 18 and 19. In similar fashion, chutes 13, 14 and 15 are provided with pairs of hopper doors 20-21, 22-23, and 24-25, respectively. The side sill 6 supports a substantially triangular, downwardly depending outer hopper sheet for each chute. Thus, for chutes 12 through 15, outer hopper sheets 26 through 29, respectively, are shown. The outer hopper sheets 26 through 29 fully enclose the lowermost outer portion of the chutes and the hopper doors close thereagainst forming a seal therewith. The side sill of the other side of the hopper car (not shown) supports a similar set of triangular outer hopper sheets.

Figure 5:
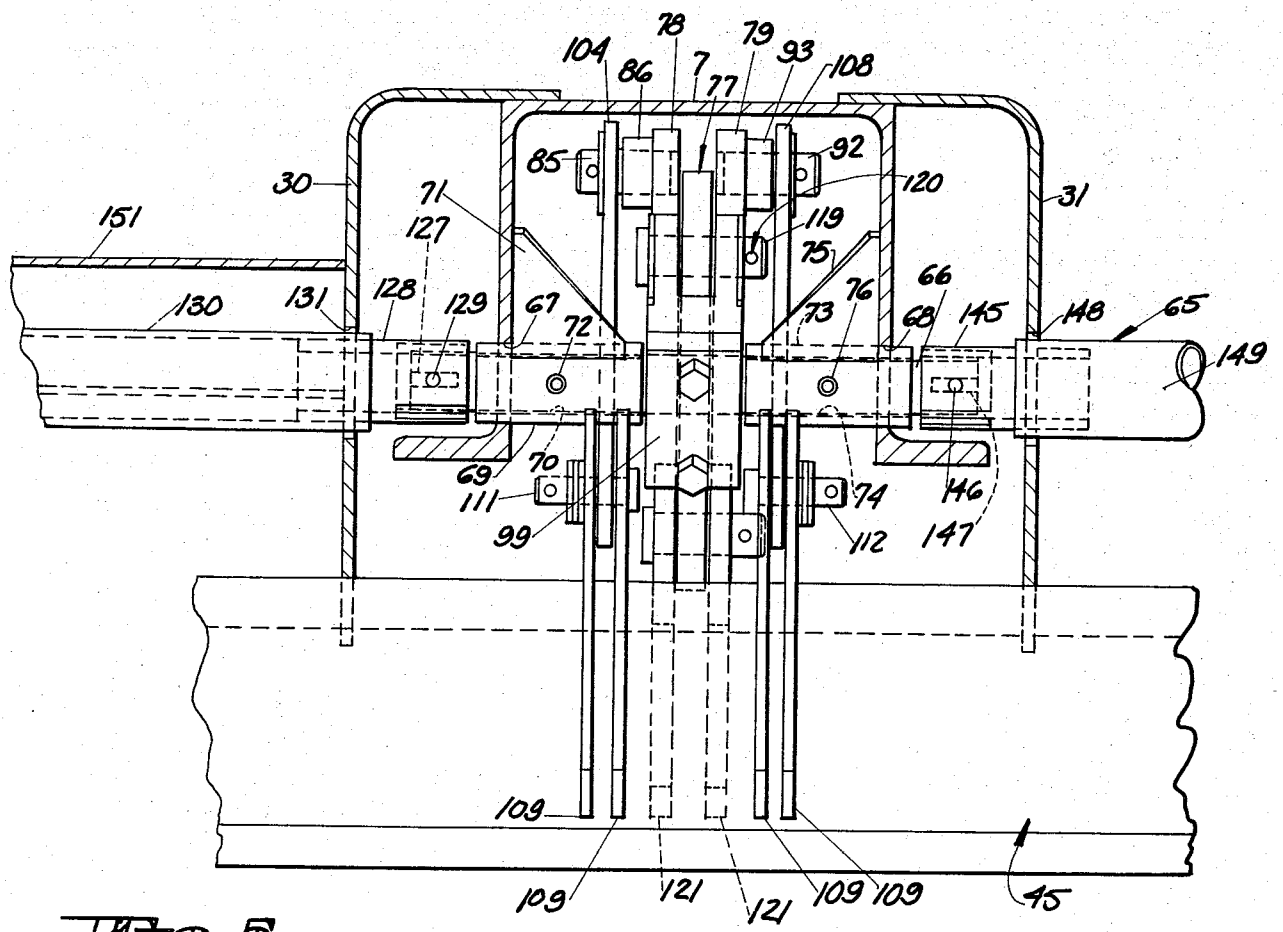
FIG. 5 is a cross sectional view taken along section line 5—5 of FIG. 2.

It will be evident from FIG. 1 that the center sill 7 of the hopper car partially bisects the lowermost portion of each of chutes 12 through 15. Thus, the lowermost portion of each chute is divided into two parts lying to either side of the center sill. As a result, it is necessary to provide inner hopper sheets of substantially triangular configuration, located to either side of the center sill 7 and against which the hopper doors close and form a seal. One such inner hopper sheet is shown at 30 in FIG. 2. In FIG. 5 the inner hopper sheet 30 is fragmentarily shown together with an inner hopper sheet 31 located on the other side of center sill 7. The manner in which the inner hopper sheets 30 and 31 are mounted on center sill 7 does not constitute a limitation on the present invention. For purposes of an exemplary showing, the inner hopper sheets 30 and 31 are shown in FIG. 5 as being affixed to the horizontal web portion of center sill 7.

Figure 2:
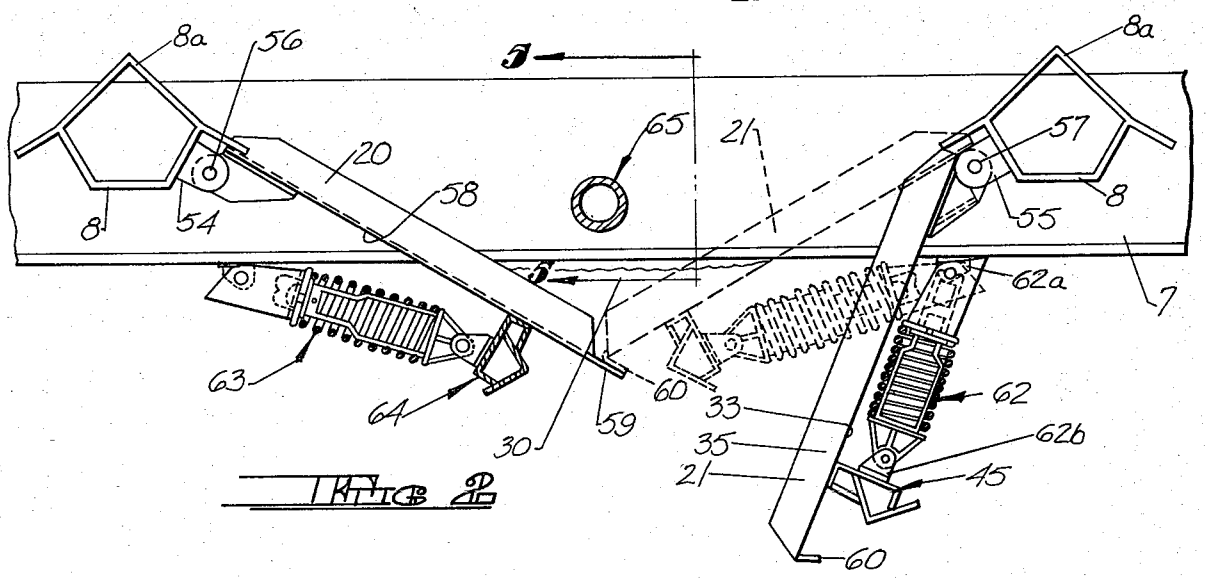
FIG. 2 is a fragmentary cross sectional view illustrating a portion of the hopper car center sill, a cooperating pair of opposed hopper doors and spring assist means for the hopper doors.
Figures 3, 4:
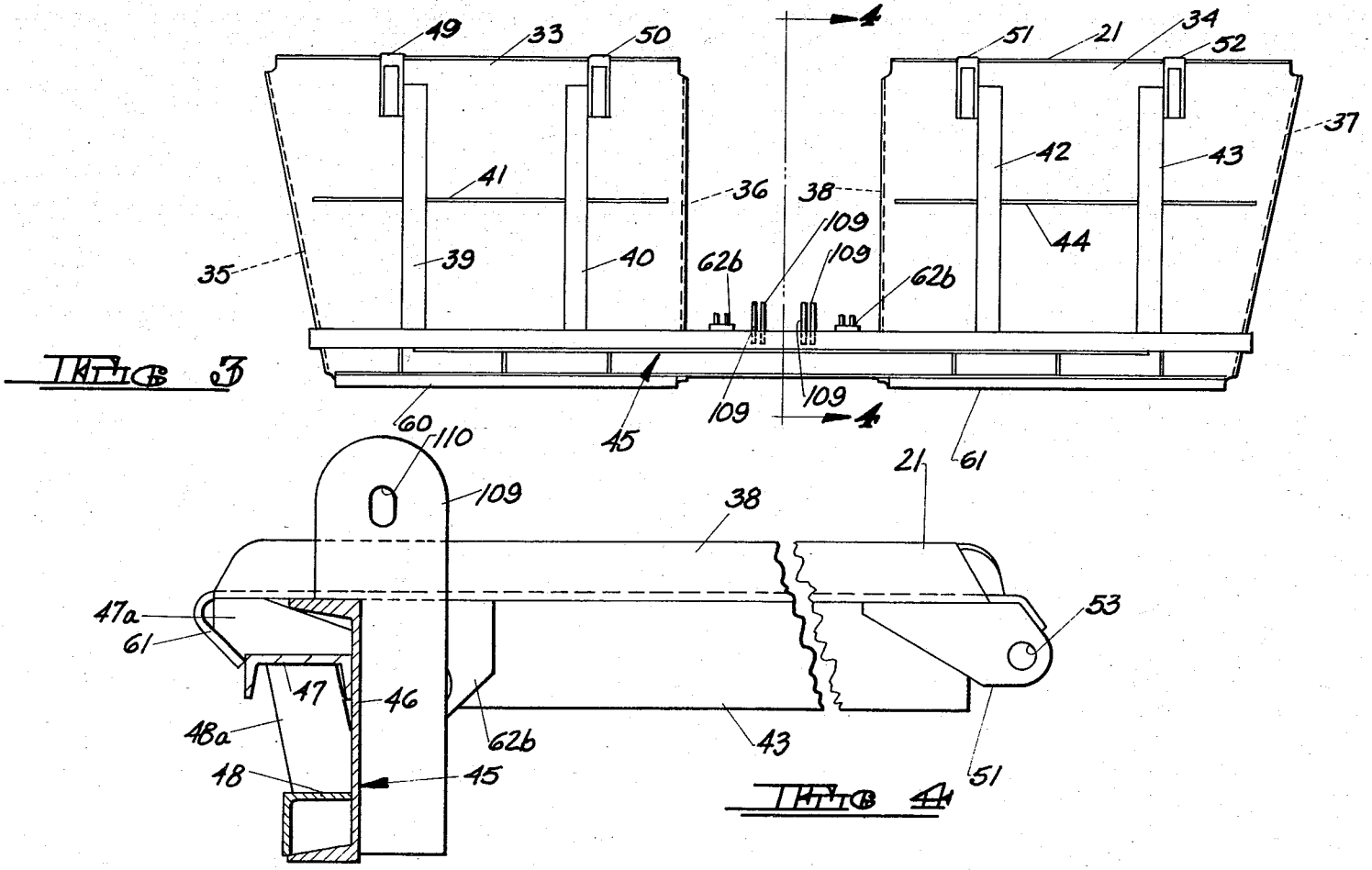
FIG. 3 is an elevational view of one hopper door of a cooperating pair thereof.
FIG. 4 is a fragmentary cross sectional view taken along the section line 4—4 of FIG. 3.

All of the hopper doors 18 through 25 are substantially identical, differing from each other only in minor details. Hopper doors 20 and 21 are illustrated in an enlarged view of FIG. 2. It will be understood that a description of this pair of doors can be considered to be a description of all of the door pairs. In FIGS. 3 and 4, the hopper door 21 is shown. FIG. 3 is an elevational view of the outer surface of hopper door 21. The hopper door comprises a pair of panels 33 and 34 which are essentially mirror images of each other. The panel 33 has a forwardly extending edge flange 35 adapted to extend about the lowermost edge of outer hopper sheet 27 (see FIG. 1). The panel 33 has a second forwardly extending edge flange 36 adapted to extend about the lowermost edge of inner hopper sheet 30 (see FIGS. 2 and 5). The panel 34 is similarly provided with forwardly extending edge flanges 37 and 38 adapted to cooperate with the lowermost edges of its respective inner and outer hopper sheets. The edge flange 38 is clearly shown in FIG. 4 and it will be understood that it will cooperate with the lowermost edge of inner hopper sheet 31 (see FIG. 5).

The panels 33 and 34 are provided on their rear sides with appropriate reinforcing members. Such reinforcing members for panel 33 are shown at 39 through 41. Substantially identical reinforcing members for panel 34 are shown at 42 through 44. The panels 33 and 34 are joined together by a transverse brace (generally indicate at 45) extending along and affixed to their rear surfaces. The transverse brace 45 may be of any appropriate configuration. As can most clearly be seen in FIG. 4, for purposes of an exemplary showing the transverse brace 45 is illustrated as being made up of structural members 46, 47, 48 and gussetts 47*a* and 48*a*.

The panels 33 and 34 are provided each with a pair of hinge elements near their upper edges. These hinge elements are shown at 49 and 50 on panel 33 and at 51 and 52 on panel 34. All of hinge elements 49 through 52 may be identical. Each of the hinge elements is provided with a transverse perforation (see transverse perforation 53 in FIG. 4) and is adapted to cooperate with a bifurcated hinge element mounted on the adjacent one of transverse brace members 8 (see FIGS. 1 and 2). In FIG. 2, two such bifurcated hinge elements are shown at 54 and 55 for each of doors 20 and 21. The bifurcated hinge elements on the transverse brace members 8 are provided with coaxial perforations so that each of hinge elements 49 through 52 on the hopper door may be rotatively connected to its respective bifurcated hinge element on the adjacent transverse brace member 8 by a hinge pin. Two such hinge pins are shown at 56 and 57 in FIG. 2. In this way, the hopper door 21 (as is true of all of the hopper doors) is hingedly supported by the adjacent transverse frame or brace member 8 so as to be swingable between a closed position and a downwardly depending open position. In FIG. 2, hopper door 21 is shown in its open position in full lines and in its closed position in broken lines.

The lowermost edges of cooperating panels of an opposed pair of hopper doors should abut each other and form a seal with each other to prevent escape of material carried within the hopper car. The above mentioned U.S. Pat. Nos. 3,596,609 teaches a number of ways in which this seal between the lowermost edges of cooperating hopper door panels can be achieved. It will be understood that the construction of hopper door 20 is substantially identical to that just described with respect to hopper door 21. In FIG. 2 hopper doors 20 and 21 are shown, hopper door 20 having a panel 58 cooperating with panel 33 of hopper door 21.

FIG. 2 illustrates one exemplary form of seal between the lowermost edges of hopper door 20 and 21. To this end, the panel 58 of hopper door 20 has a lowermost edge portion 59 which is coplanar therewith. The panel 33 of hopper door 21, however, has a lowermost edge portion configured to form a curved return flange 60. The return flange 60 of panel 33 is shown in FIG. 3. Panel 34 is provided with a similar return flange 61. This flange is most clearly shown in FIG. 4.

When cooperating pairs of hopper doors 20 and 21 are provided with sealing means along their lowermost edges of the type just described, it is necessary that hopper door 21 close slightly ahead of hopper door 20 so that hopper door 21 may be considered an "inner hopper door" and hopper door 20 may be considered an "outer hopper door". During the closing procedure, since hopper door 21 closes just ahead of hopper door 20, the lowermost edge portions (one of which is shown at 59 in FIG. 2) of hopper door 20 will engage the return flanges 60 and 61 of hopper door 21 assisting in the closure of hopper door 21. As the hopper car is loaded, the hopper doors 20 and 21 will "seat" under the weight of the lading. The return flanges 60 and 61 of hopper door 21 will bear against and conform to the lowermost edge portions (one of which is shown at 59) of hopper door 20 forming a continuous metal-to-metal seal along these lines of contact.

While not required, it is preferred in the practice of the present invention to provide the hopper doors with spring loaded door closing assists. As indicated above, exemplary door closing assists are taught in U.S. Pat. Nos. 3,192,876 and 3,776,142. Briefly, such assists comprise spring loaded members pivotally affixed at one end to the hopper car body underframe and at the other end to a portion of the hopper doors such as the transverse brace 45 thereof. Generally, each hopper door is provided with two such assists which are so constructed as to serve as spring loaded stops to help determine the open position of the hopper door and to assist in shifting the hopper door from its open position to its closed position. One such assist means is generally indicated at 62 and is shown pivotally affixed to one end to the hinge element 62*a* of center sill 7 and at its other end to the transverse brace 45 of hopper door 21. Another assist means is shown in FIG. 2 at 63 having one of its ends pivotally affixed to the center sill 7 and its other end pivotally affixed to transverse brace 64 of hopper door 20, which is equivalent to the transverse brace 45 of hopper door 21.

Figure 6:
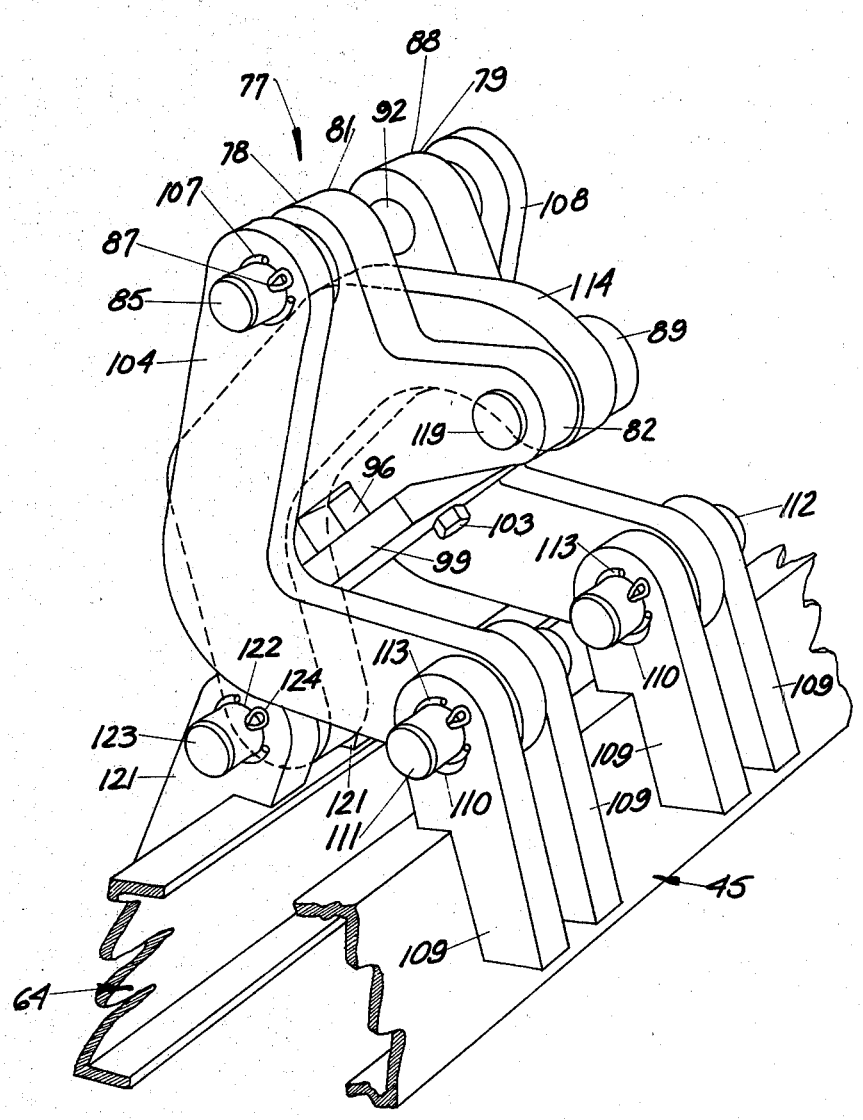
FIG. 6 is a fragmentary perspective view illustrating portions of the cooperating pair of hopper doors, the L-shaped lever structure and the links connecting the L-shaped lever structure to the hopper doors.

The door actuating and locking means of the present invention will be described in terms of its application to the pair of hopper doors 20 and 21 of FIG. 2. It will be understood that hopper door pairs 18-19, 22-23 and 24-25 will each be provided with a similar door actuating and locking means. Reference is now made to FIGS. 5 and 6 wherein like parts have been given like index numerals. The door actuating and locking means for hopper doors 20 and 21 comprises a shaft assembly generally indicated at 65. The shaft assembly has been eliminated in FIG. 6 for purposes of clarity. The shaft assembly extends transversely of the hopper car from side-to-side thereof and is located between hopper doors 20 and 21, as is evident in FIG. 2. In FIG. 5, the centermost portion of the shaft assembly is shown as comprising a shaft or rod element 66 of circular cross section.

The shaft 66 is rotatively mounted in center sill 7. To this end, center sill 7 is provided with coaxial perforations 67 and 68. Welded to center sill 7, within perforation 67, there is a cylindrical bearing 69 having an axial bore 70 therethrough which is coaxial with the shaft 66. The shaft 66 extends through the cylindrical bearing 69 which is additionally braced by a triangular gusset 71 welded thereto and to the inside surface of center sill 7. Cylindrical bearing 69 may also be provided with a grease fitting 72 (see FIG. 5). The other side of center sill 7 is provided with a cylindrical bearing 73 mounted in perforation 68. Cylindrical bearing 73 is the same as cylindrical bearing 69 and serves the same purpose. Cylindrical bearing 73 has an axial bore 74 therethrough, through which shaft 66 extends. Cylindrical bearing 73 may be additionally supported by a triangular gusset 75 (similar to gusset 71) and provided with a grease fitting 76.

Figure 11:
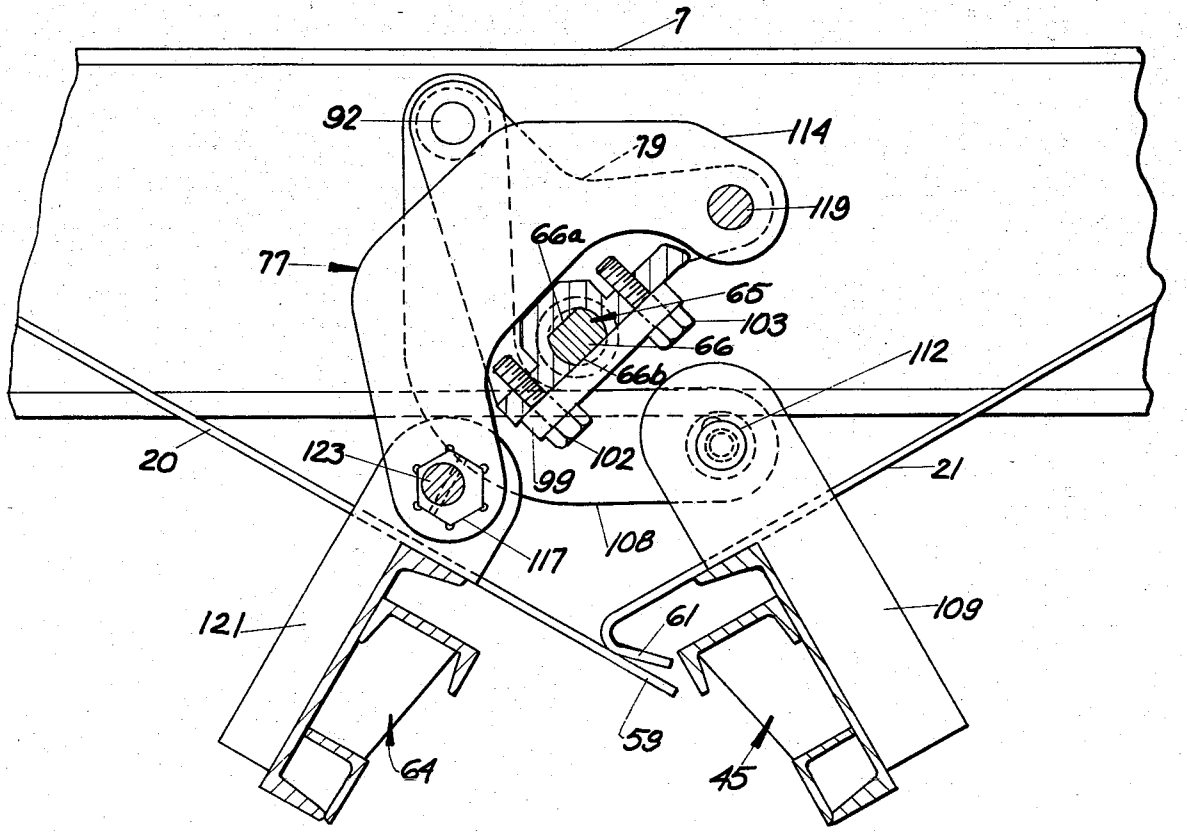
FIG. 11 is a fragmentary, semi-diagrammatic elevational view, partly in cross section, illustrating the shaft assembly, L-shaped lever structure, links and hopper doors in their respective hopper door-closed positions.

The centermost portion of shaft 66 has a pair of diametrically opposed flats 66*a* and 66*b* formed thereon, as is shown in FIG. 11. To this centermost portion of shaft 66 there is non-rotatively mounted a lever structure, generally indicated at 77. The lever structure 77 comprises a pair of L-shaped lever portions 78 and 79 and an intermediate spacer portion 80. The portions 78, 79 and 80 are preferably formed as a single, one-piece casting. On the other hand, these portions may constitute separate elements welded, bolted or otherwise affixed together. In the Figures, the lever structure 77 is shown as an integral, one-piece casting.

Figure 8:
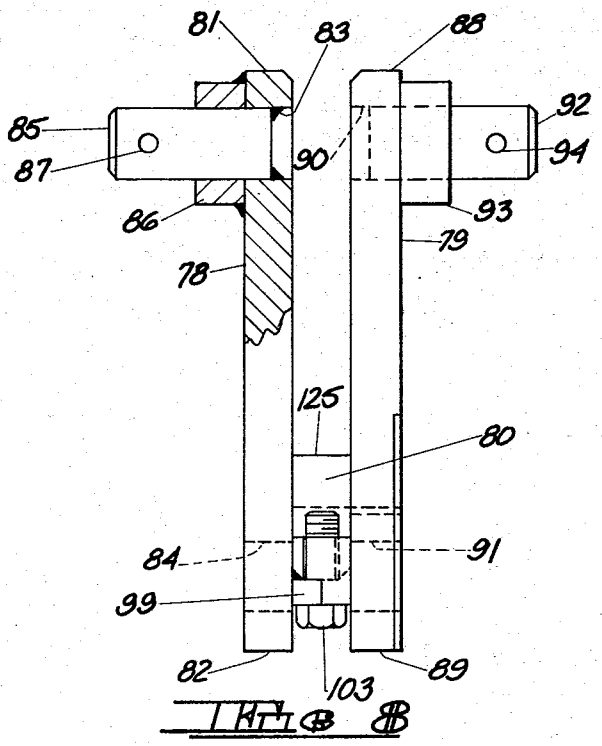
FIG. 8 is an end elevational view, partly in cross section, of the L-shaped lever structure of FIG. 7 as seen from the right of FIG. 7.
Figure 7:
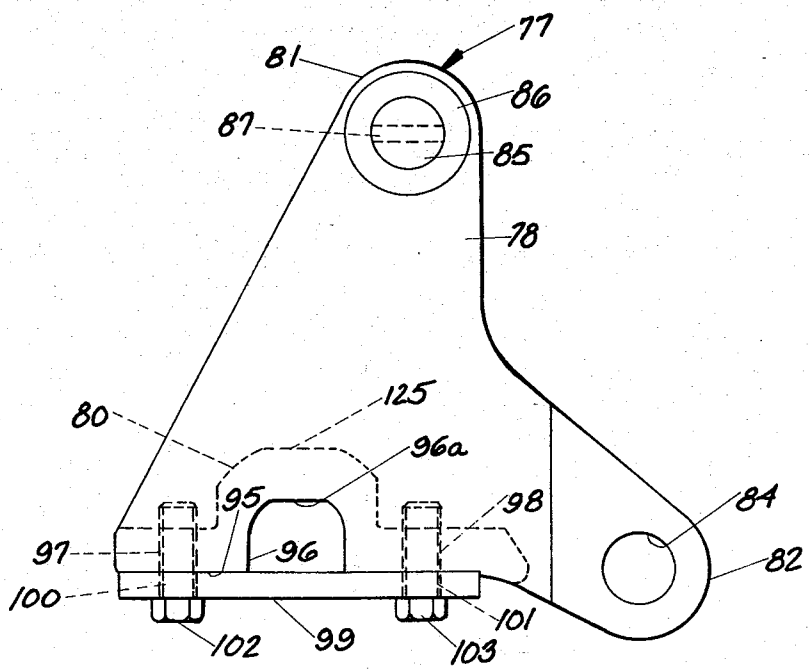
FIG. 7 is a side elevational view of the L-shaped lever structure.

Lever structure 77 is illustrated in FIGS. 7 and 8, as well as FIGS. 5 and 6. In all of these Figures, like parts have been given like index numerals. Lever portion 78 is substantially L-shaped, as can be most clearly seen in FIG. 7. The lever portion 78 has a first leg 81 and a second leg 82. Leg 81 has a transverse perforation 83 formed therein (see FIG. 8). The second leg 82 has a similar transverse perforation 84 therethrough.

Perforation 83 is adapted to receive a pin 85. The pin 85 is welded or otherwise permanently affixed in perforation 83, as shown in FIG. 8. A cylindrical spacer 86 surrounds pin 85 and is located adjacent lever portion 78. Spacer 86 is permanently affixed to lever portion 78 as by welding or the like. Spacer 86 also serves to support pin 85 which is cantilevered. It will be understood that spacer 86 and pin 85 could constitute integral, one-piece parts of lever portion 78. The free end of pin 85 has a transverse perforation 87 extending therethrough, the purpose of which will be apparent hereinafter.

Lever portion 79 constitutes a mirror image of lever portion 78, having a first leg 88, a second leg 89, and perforations 90 and 91 in legs 88 and 89, respectively. The perforation 90 is provided with a pin 92, identical to pin 85. Pin 92 is surrounded by a spacer 93 (identical to spacer 86) and is provided with a transverse perforation 94, equivalent to transverse pin perforation 87.

The lever portions 78 and 79 and the intermediate spacer portion 80 of lever structure 77 have a planar bottom surface 95. A transverse notch 96 is formed in these members having a planar upper surface 96*a*. Intermediate spacer portion 80 has a pair of threaded holes 97 and 98 formed therein. A plate 99 is provided, having clearance holes 100 and 101 therein, coaxial with threaded perforations 97 and 98 of intermediate spacer portion 80. The plate 99 is affixed to the bottom planar surface 95 of the lever structure 77 by means of bolts 102 and 103 threadedly engaged in perforations 97 and 98, as is most clearly seen in FIG. 7. Alternatively the perforations 97 and 98 could be unthreaded with a nut welded to the upper surface of intermediate spacer portion 80 above and coaxial with each perforation 97 and 98 for engagement by bolts 102 and 103.

Notch 96 is so sized as to just nicely receive the centermost portion of shaft 66 in such a way that the shaft flat 66*a* is abutted by notch surface 96*a* and the shaft flat 66*b* is abutted by plate 99 in a clamping action. (See FIG. 11). In this way, the lever assembly 77 is non-rotatively affixed to shaft 66.

Figure 9:
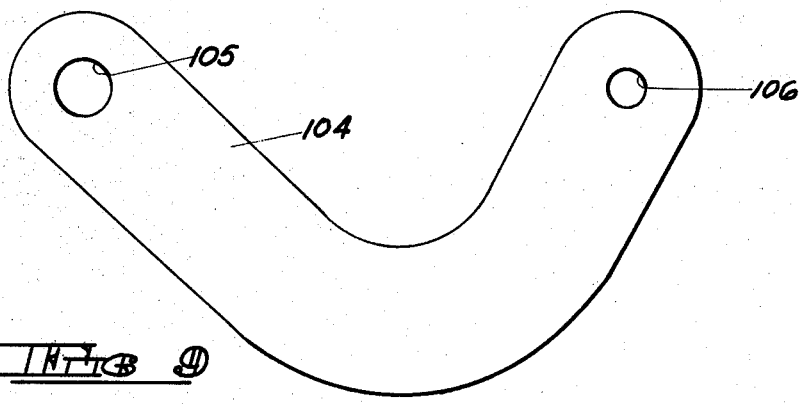
FIG. 9 is an elevational view of one of the inner door links.

FIG. 9 illustrates a V-shaped link 104 having perforations 105 and 106 extending transversely through its ends. The perforation 105 in link 104 is so sized as to receive the pin 85 of lever structure 77, the link 104 being pivotally affixed in this manner to the lever structure. The link 104 is held in place on pin 85 by any appropriate means such as a cotter pin 107 extending through transverse perforation 87 of FIG. 5 (see FIG. 6). A second V-shaped link 108, identical to link 104, is pivotally mounted on pin 92 of lever structure 77 and can be held in place in an identical manner.

As is clearly shown in FIGS. 3, 5 and 6, the central portion of the transverse brace 45 of hopper door 21 is provided with two pairs of identical fulcrum means 109, welded or otherwise permanently affixed thereto. Fulcrum means 109 is provided with a perforation 110 therethrough. The free end of lever 104 is adapted to be received between the adjacent pair of fulcrum means 109 with its perforation 106 coaxial with the perforations 110 in the fulcrum means. A pivot pin 111 passes through the fulcrum perforations 110 and the lever perforation 106 so that the lever 104 is pivotally attached to the hopper door 21. The lever 108 is similarly pivotally attached to the other pair of fulcrum means 109 by pivot pin 112. Pivot pins 111 and 112 may be held in place by any appropriate means such as cotter pins, two of which are shown in FIG. 6 at 113.

Figure 10:
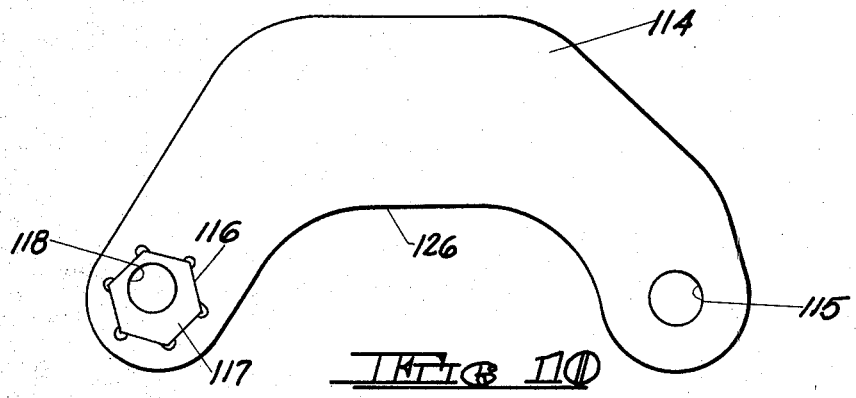
FIG. 10 is an elevational view of the outer door link.
Figure 10:
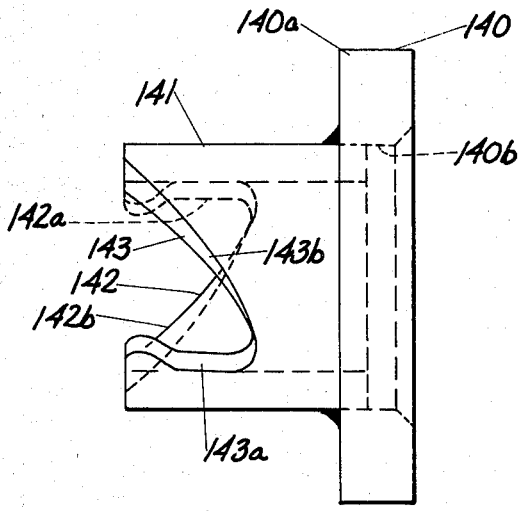

Another V-shaped link is illustrated at 114 in FIG. 10. The link 114 is provided at its ends with perforations 115 and 116. The perforation 116 is of hexagonal configuration to receive a hexagonal adjustment insert 117. Adjustment insert 117 has a hole 118 eccentrically located therethrough. The purpose of adjustment insert 117 will be evident hereinafter.

In the assembly, the link 114 is so located as to have its perforation 115 coaxial with the perforation 84 in the second leg 82 of lever portion 78 and the corresponding perforation 91 in the second leg 89 of lever portion 79. This enables the link 114 to be pivotally affixed to and between the second legs of lever portions 78 and 79 by means of a pivot pin 119. The pivot pin 119 is held in place in any suitable manner, such as by being provided with a head at one end and a cotter pin 120 at the other end (see FIG. 5).

As is further shown in FIGS. 5 and 6, the transverse brace 64 of hopper door 20 is provided with a single pair of fulcrum means 121 having perforations 122 therethrough. The free end of link 114 is disposed between the pair of fulcrum means 121 with the perforation 118 in adjustment insert 117 coaxial with the fulcrum perforations 122 so that the link 114 can be pivotally affixed to the fulcrum means by pivot pin 123. Once again, pivot pin 123 may be maintained in place by any suitable means such as cotter pins, one of which is shown at 124. It will be noted from FIGS. 5, 6 and 10 that the single link 114 attached to hopper door 20 is of heavier construction and thicker than the links 104 and 108 attached to hopper door 121. This is true for two reasons. First of all, hopper door 20 is operated by the single link 114, rather than by two links, as is hopper door 21. Furthermore, as indicated above, the links 104, 108 and 114 are so configured as to cause hopper door 21 to close slightly ahead of hopper door 20. The location of pivot pins 85 and 92 in legs 81 and 88 and pivot pin 119 in legs 82 and 89 may be such as to cause the doors 20 and 21 to pass over-center simultaneously during the door closing operation. The doors will achieve their final closed positions as shown in FIG. 2, since door 21 is slightly shorter than door 20 by virtue of its curved return flanges 60 and 61 (see FIG. 3). Alternatively, the above mentioned pivot pins may be so located in their respective legs as to cause door 21 to pass over-center slightly ahead of door 20, so that as door 20 approaches its final closed position, door 21 is beginning to shift downwardly again. During the last portion of its travel to its fully closed position, door 20 will lift door 21 slightly to assure a seal therebetween. This slight lifting action is accommodated by adjustment insert 117 of link 114 and by slightly elongating the holes 110 in fulcrums 109 receiving pivot pins 111 or 112. This slight elongation is shown in FIGS. 4, 6, 11 and 12.

FIGS. 5 and 6 illustrate the shaft assembly 65 and lever structure 77 in their closed positions. The same is true of FIG. 11 wherein hopper doors 20 and 21, shaft assembly 65 and lever structure 77 are shown in semi-diagrammatic form. Like parts have been given like index numerals. It will be understood, that since FIG. 11 is a view of the shaft assembly and lever structure as seen from the left in FIG. 6, lever portion 78 and link 104 have been omitted for purposes of clarity.

It will be evident from FIG. 11 that when the shaft assembly 65 and lever structure 77 (and hence doors 20 and 21) are in their closed positions, imaginary lines drawn between pivot pins 92 and 112 and pivot pins 119 and 123 will both lie to the right of the center of shaft assembly 65, indicating that the entire assembly is in an over-center condition. Thus, forces acting to open the doors when the doors are in their closed positions will in fact cause the structure to tend to close the doors more tightly.

To determine the over-center, closed positions of the shaft assembly 65 and lever structure 77, stop means may be provided. The stop means may take any appropriate form. Advantageously, stop means can be provided within the lever structure 77, itself. To this end, the intermediate spacer portion 80 of lever structure 77 has a flat 125 formed on its upper surface above notch 96 (see FIG. 7). Similarly, link 114 has a flat surface 126 formed thereon (see FIG. 10). As is evident from FIG. 11, surfaces 125 and 126 are in abutment with the lever structure in its door-closed, over-center configuration. Abutment of surfaces 125 and 126 precludes further rotation of shaft assembly 65 in a clockwise direction (as viewed in FIG. 11), thus providing stop means to determine the over-center closed positions of doors 20 and 21.

Figure 12:
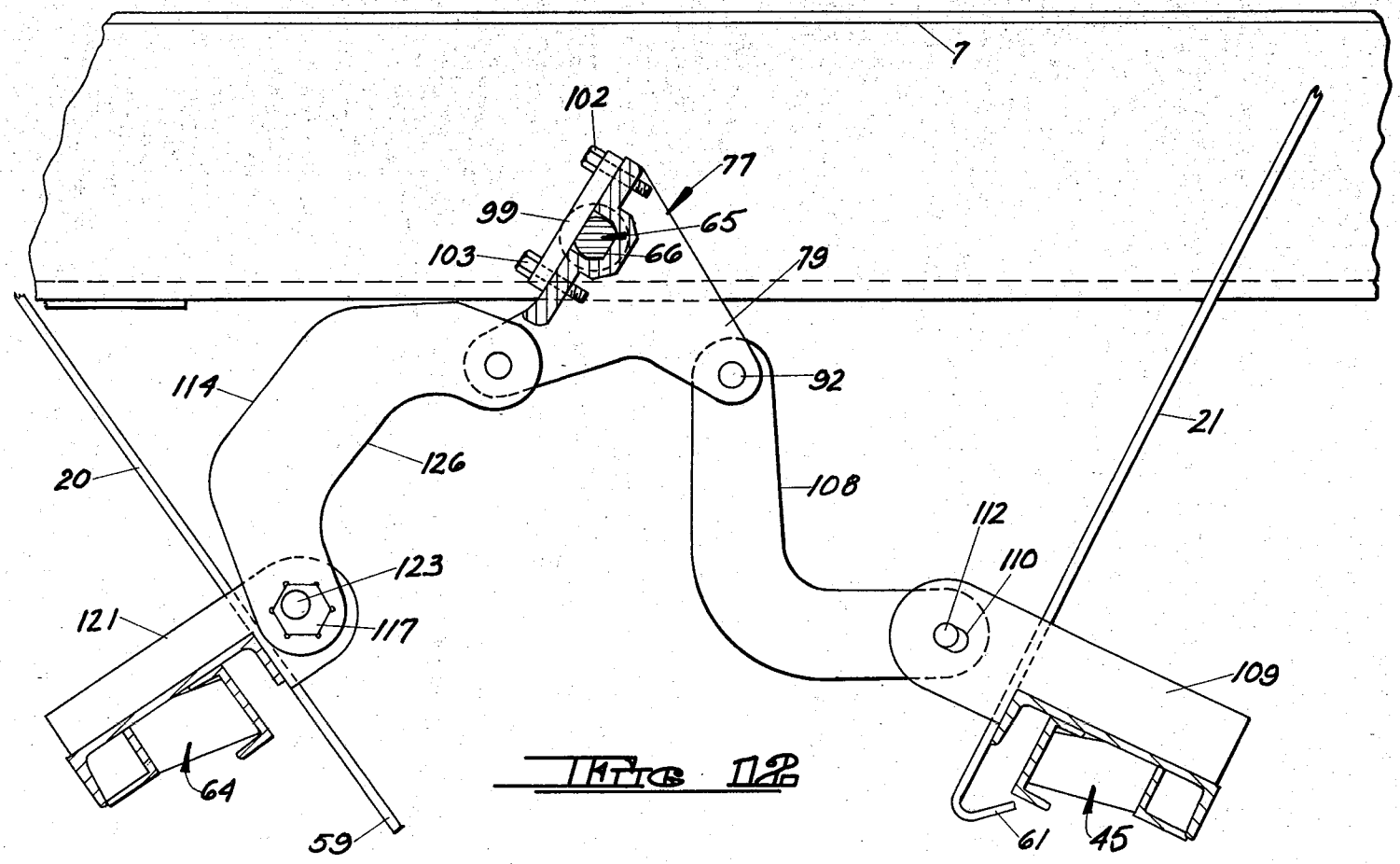
FIG. 12 is a fragmentary, semi-diagrammatic view, partly in cross section, illustrating the shaft assembly, L-shaped lever structure, links and hopper doors in their respective hopper door-open position.

Reference is now made to FIG. 12. FIG. 12 is a semi-diagrammatic representation of shaft assembly 65, lever structure 77, links 108 and 114, and hopper doors 20 and 21. FIG. 12 is similar to FIG. 11, but illustrates these elements in their door-open positions. Again, lever portion 78 and link 104 have been omitted for purposes of clarity. To achieve the door-open positions of these elements, as shown in FIG. 12, it is only necessary to rotate the shaft assembly 65 in a counter clockwise direction (as viewed in FIGS. 11 and 12) until such time as the assembly passes through its over-center position, wherein the weight of hopper doors 20 and 21, together with the lading bearing thereagainst, will cause the assembly to achieve the position illustrated in FIG. 12. In similar fashion, to return the assembly to its configuration shown in FIG. 11, it is only necessary to rotate the shaft assembly 65 in a clockwise direction (as viewed in FIGS. 11 and 12), until the over-center positions of these elements (as shown in FIG. 11) are achieved. The spring assist means, two of which are shown at 62 and 63 in FIG. 2, will aid the clockwise rotation of shaft assembly 65.

As indicated above, it is desirable that the shaft assembly 65 be manually rotatable from either side of the hopper car body 1. To this end, the left end of shaft 66 (as viewed in FIG. 5) is provided with a slot 127. A tubular adaptor 128 has an axial bore so sized as to just nicely receive the adjacent end of shaft 66. Adaptor 128 has a pair of diametrically opposed holes formed therein through which a pin 129 extends. The pin 129 is welded or otherwise affixed to adaptor 128 and is so sized as to be receivable in slot 127 in the end of shaft 66.

The other end of adaptor 128 is received in the end of a tubular shaft 130. Adaptor 128 and tubular shaft 130 are welded, or otherwise permanently joined together. Tubular shaft 130 extends with clearance through a hole 131 through inner hopper sheet 30.

Figure 13:
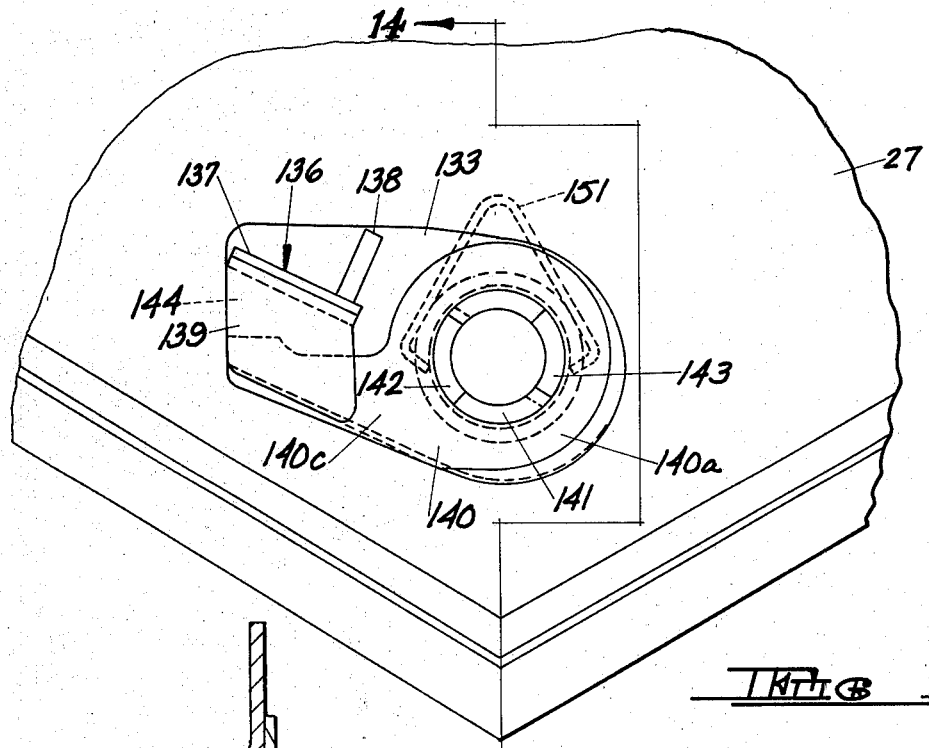
FIG. 13 is an elevational view of one end of the shaft assembly and the support plate and actuating lever therefor.
Figure 14:
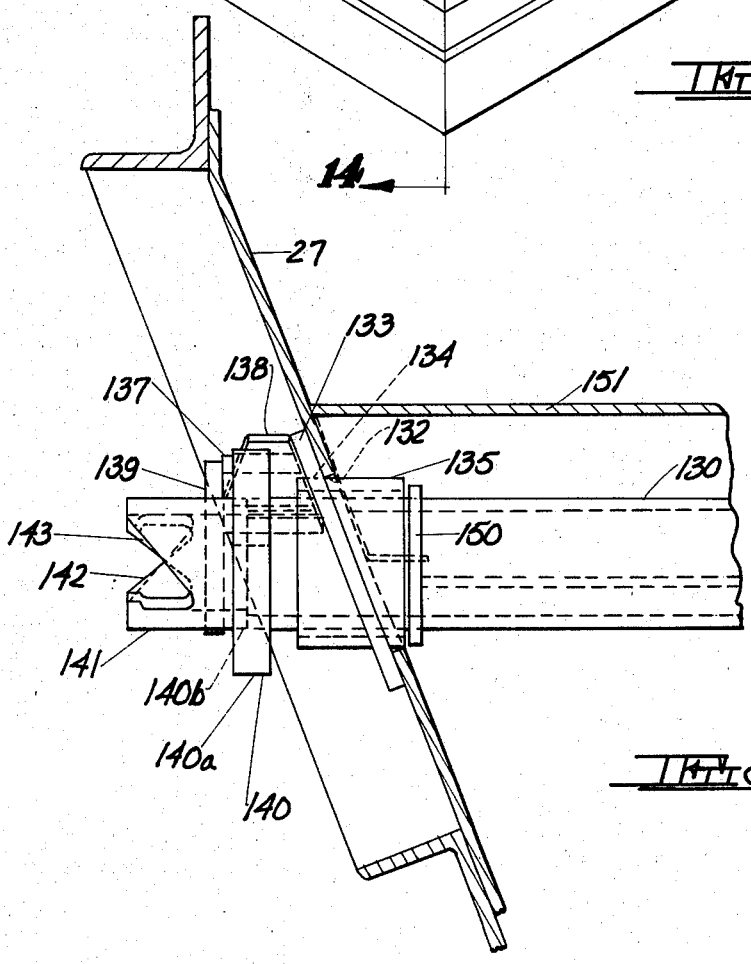
FIG. 14 is a cross sectional view taken along section line 14—14 of FIG. 13.
Figure 15:
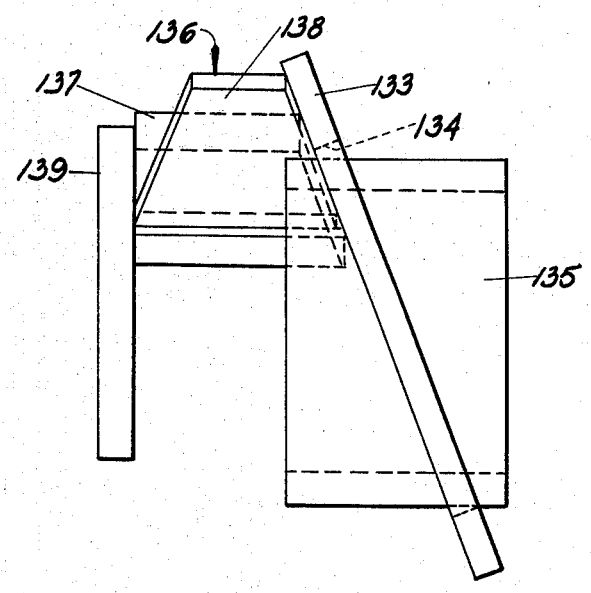
FIG. 15 is a side elevational view of the shaft assembly support plate as viewed from the left of FIG. 13.

Reference is now made to FIGS. 13, 14 and 15. It will be evident from these Figures that the outermost end of tubular shaft 130 passes through outer hopper sheet 27. For this purpose, the outer hopper sheet is provided with a perforation 132. To act as a bearing means for the outer end of tubular shaft 130, a support assembly is affixed to the outer hopper sheet 27. The support assembly is shown in FIGS. 13, 14 and 15, and comprises a support plate 133 appropriately affixed to outer hopper sheet 27, as by welding, bolting or the like (not shown). The support plate 133 has a perforation 134 formed therein through which a cylindrical member 135 extends. The cylindrical member 135 is welded or otherwise permanently affixed to support plate 133 and serves as both a support and bearing for the outermost end of tubular shaft 130. It will be noted that cylindrical member 135 extends partway through the perforation 132 of outer hopper sheet 27.

The support plate 133 also carries a bracket, generally indicated at 136. The bracket is made up of an outwardly extending member 137 and a brace 138 therefore. The free end of member 137 has a downwardly depending member 139 affixed thereto. The elements making up bracket 136 are welded together and to support plate 133. It would be within the scope of the present invention to form bracket 136 and support plate 133 as a single, one-piece, cast structure. The purpose of bracket 136 will be described hereinafter.

That portion of tubular shaft 130 which projects beyond outer hopper sheet 27 and support plate 133 carries an actuating lever 140. The actuating lever 140 has a body portion **140*a* provided with a perforation 140*b* adapted to just nicely receive the end of tubular shaft 130. The actuating lever is non-rotatively affixed to the end of tubular shaft 130 by welding or the like. The actuating lever also has a laterally extending portion 140*c***, the purpose of which will be described hereinafter.

A cylindrical extension 141 is also inserted into perforation **140*b* of actuating lever 140 and is welded to the actuating lever. Cylindrical extension 141 is provided with a pair of diametrically opposed notches 142 and 143 (see FIG. 16). These notches are identical in configuration. Notch 142 has a horizontal working surface 142*a* and an arcuate non-working surface 142*b*. Similarly, notch 143 has a horizontal working surface 143*a* and an arcuate non-working surface 143*b*. The purpose of notches 142 and 143** will be described hereafter.

The operation of the structure thus far described can be set forth as follows. It will be remembered that FIG. 11 illustrates the shaft assembly 65 and lever structure 77 in their door-closed positions. In order for these elements to achieve their door-open positions as shown in FIG. 12, it is necessary to rotate the shaft assembly 65 counter clockwise (as viewed in FIG. 11) until the assembly passes through its over-center position. FIG. 13 illustrates the outermost end of tubular shaft 130 and its actuating lever 140 in their door-closed positions, corresponding to FIG. 11. It will be noted that the lateral extension **140*c*, of actuating lever 140 is located within bracket 136**.

The bracket 136 serves a number of purposes (see FIGS. 13 and 15). First of all, it protects the laterally extending portion **140*c* of actuating lever 140. Secondly, the bracket 136 and the laterally extending portion 140*c* of actuating lever 140 form a small pocket 144 into which the endmost portion of a pry bar may be inserted. Either an upward or a downward prying movement of the pry bar against the upper surface of the laterally extending portion 140*c* of actuating lever 140 and the inside surface of the member 137 of bracket 136 will cause the necessary counter clockwise rotation of shaft assembly 65 to shift it from its door-closed position shown in FIG. 11 to its door-open position shown in FIG. 12. Since the pocket 144 will accommodate only the endmost portion of a pry bar, a large mechanical advantage results, enabling the pry bar to rotate shaft assembly 65 through its over-center position against the weight of doors 20 and 21** and the lading bearing thereagainst.

It will be noted from FIG. 13 that, when the shaft assembly is in its door-closed position, a portion of the lateral extension **140*c* of actuating lever 140 is located wholly within bracket 136. This portion of lateral extension 140*c* can be painted with a bright contrasting color and if any part of the brightly colored portion of the actuating lever 140 is exposed, a workman can immediately determine, even from a distance, that the pair of hopper doors controlled by lever 140 are not in their fully closed positions. Thus, the lateral extension 140*c* of lever 140 and bracket 136** can be made to cooperate as a visual indicator of the condition of the hopper doors.

To return hopper doors 20 and 21 from their open position as shown in FIG. 12 to their closed position as shown in FIG. 11, it is necessary to rotate shaft assembly 65 in a clockwise direction (as viewed in FIGS. 11, 12 and 13). To accomplish this, the same pry bar tool may be inserted in notches 142 and 143 of cylindrical extension 141. It will be evident that only a movement of the pry bar in such a way as to cause a clockwise rotation of shaft assembly 65 is possible, so that the pry bar will bear against the working surfaces 142 and 143 of notches 142 and 143. Incorrect shifting of the pry bar will cause it to contact the non-working surfaces **142*b* and 143*b* of notches 142 and 143 which will simply shift the pry bar out of engagement with these notches. This arrangement is purposeful so that the notches 142 and 143 are used by a workman only to return the hopper doors from their open positions to their closed positions. If the notches 142 and 143 could be used to open the hopper doors, as the doors pass over-center and then fall to their open position, the pry bar might be wrenched from the workman's hands resulting in injury. Thus, to open the hopper doors, the workman must insert the pry bar in pocket 144 formed by bracket 136 and actuating lever 140** so as to obtain the above noted mechanical advantage against the weight of the doors and the lading bearing thereagainst.

Returning to FIG. 5, it will be noted that the right-hand end of shaft 66 is provided with a tubular adaptor 145, equivalent to tubular adaptor 128. The tubular adaptor 145 has a transverse pin 146, equivalent to pin 129. The adjacent end of shaft 66 has a pin-receiving slot 147 equivalent to slot 127. The inner hopper sheet 31 has a perforation 148 therein (equivalent to perforation 131 in inner hopper sheet 30) permitting a tubular shaft 149 (equivalent to tubular shaft 130) to pass therethrough. It will be understood that tubular shaft 149 is non-rotatably affixed to adaptor 145.

The tubular shaft 149 will pass through its respective outer hopper sheet and will be provided with a support plate, bracket and actuating lever, equivalent to (but mirror images of) support plate 133, bracket 136 and actuating lever 140. The actuating lever for tubular shaft 149 will have an extension (equivalent to cylindrical extension 141) with a pair of diametrically opposed notches equivalent to notches 142 and 143.

As a result, there is a duplication of elements on the opposite side of the hopper car so that the shaft assembly 65 can be operated in precisely the same manner to shift hopper doors 20 and 21 between their open and closed positions from either side of the hopper car. To assure proper location of all of the elements of shaft assembly 65 and to prevent undue axial shifting thereof, a bearing washer is tack welded to each tubular shaft 130 and 149. One such washer is shown at 150 in FIG. 14.

Since shafts 130 and 149 are located within their respective chute, it is desirable to provide these tubular shafts with guard means. One such guard means for shaft 130 is illustrated at 151 in FIGS. 5, 13 and 14. The guard means 151 is welded or otherwise affixed to inner hopper sheet 30 at one end and outer hopper sheet 27 at the other. It will be evident from FIG. 13 that guard means 151 has a substantially triangular cross section so that it will not interfere with the lading as it is discharged from the chute. Tubular shaft 149 will be provided with an identical guard means (not shown).

Since the hopper doors and their lever structure 77 are in an over-center position when the hopper doors are closed, the hopper doors are, in essence, locked in their closed positions. Under some circumstances, however, it is desirable to provide a positive, manually operated lock for each cooperating pair of hopper doors which will assure that the doors will remain in their closed positions under all static and dynamic conditions of the hopper car. FIGS. 17 through 20 illustrate such a manually operated lock for a pair of cooperating hopper doors, which lock can be activated and deactivated by a single workman from either side of the hopper car.

Figure 17:
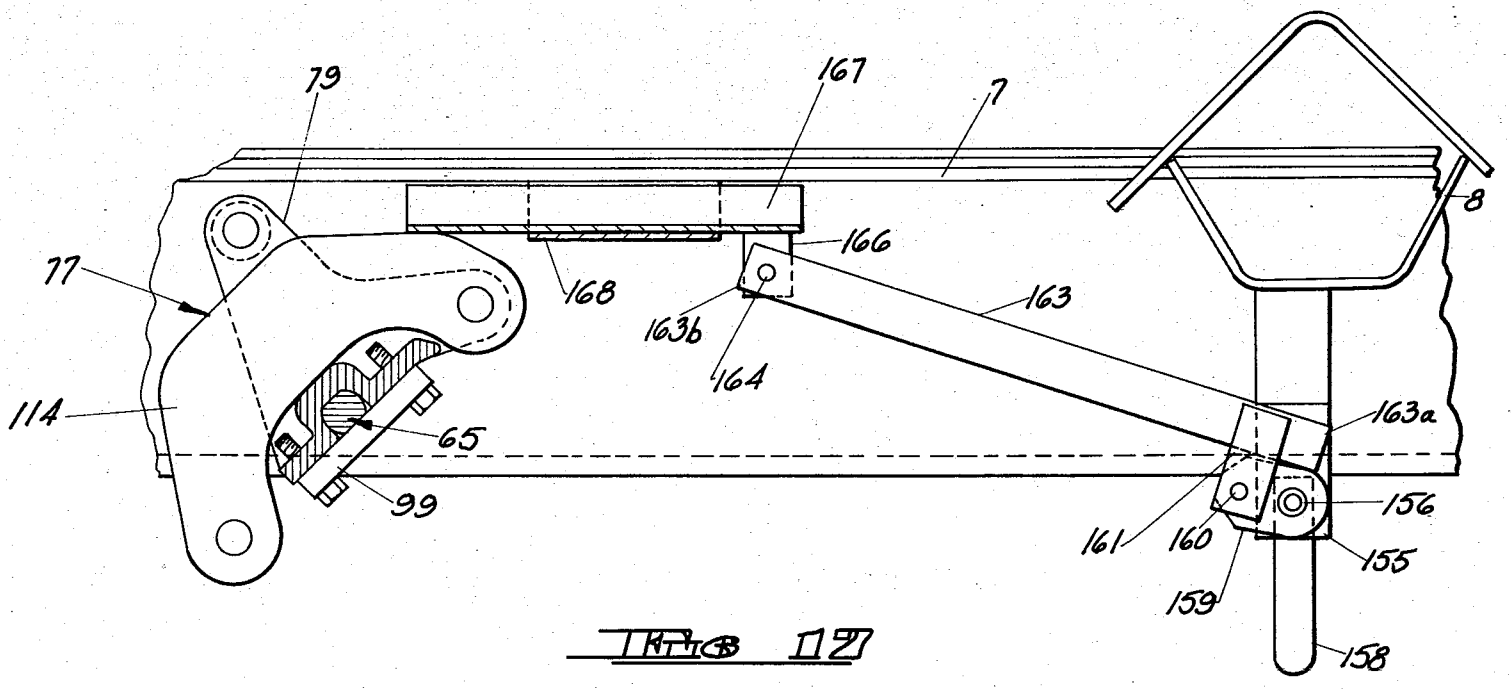
FIG. 17 is a fragmentary elevational view, partly in cross section, illustrating a manual door lock assembly in locking position.

FIG. 17 is a fragmentary cross sectional view similar to FIG. 11, and like parts have been given like index numerals. As in the case of FIG. 11, the shaft assembly 65 and lever structure 77 are illustrated, lever portion 78 not being shown. For purposes of clarity, links 104 and 108 have been omitted.

Figure 18:
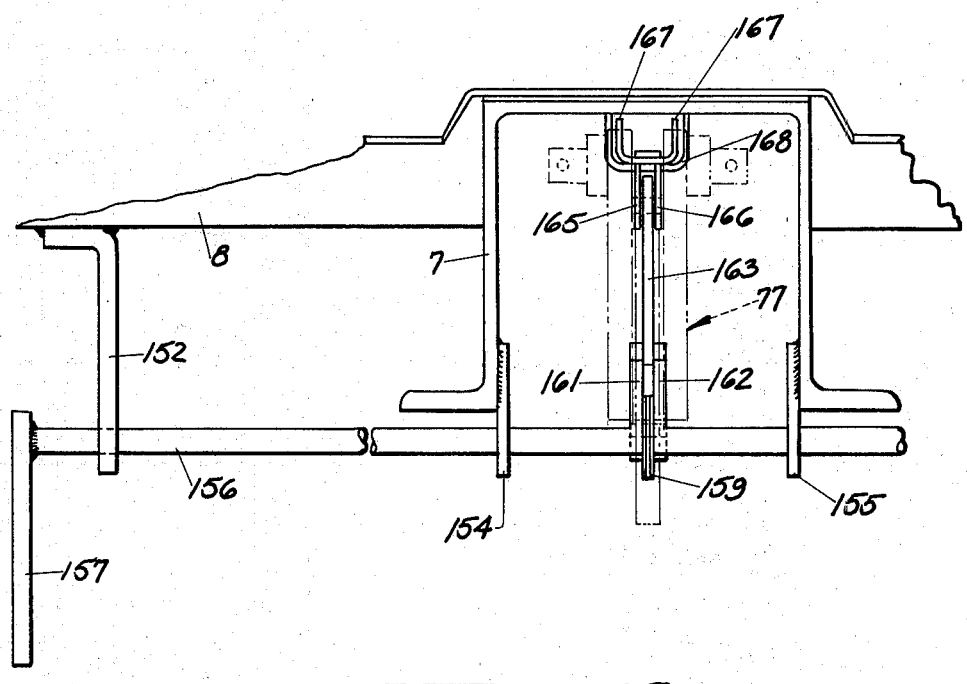
FIG. 18 is a fragmentary end elevational view, partly in cross section, of the structure of FIG. 17 as seen from the right of that Figure.
Figure 19:
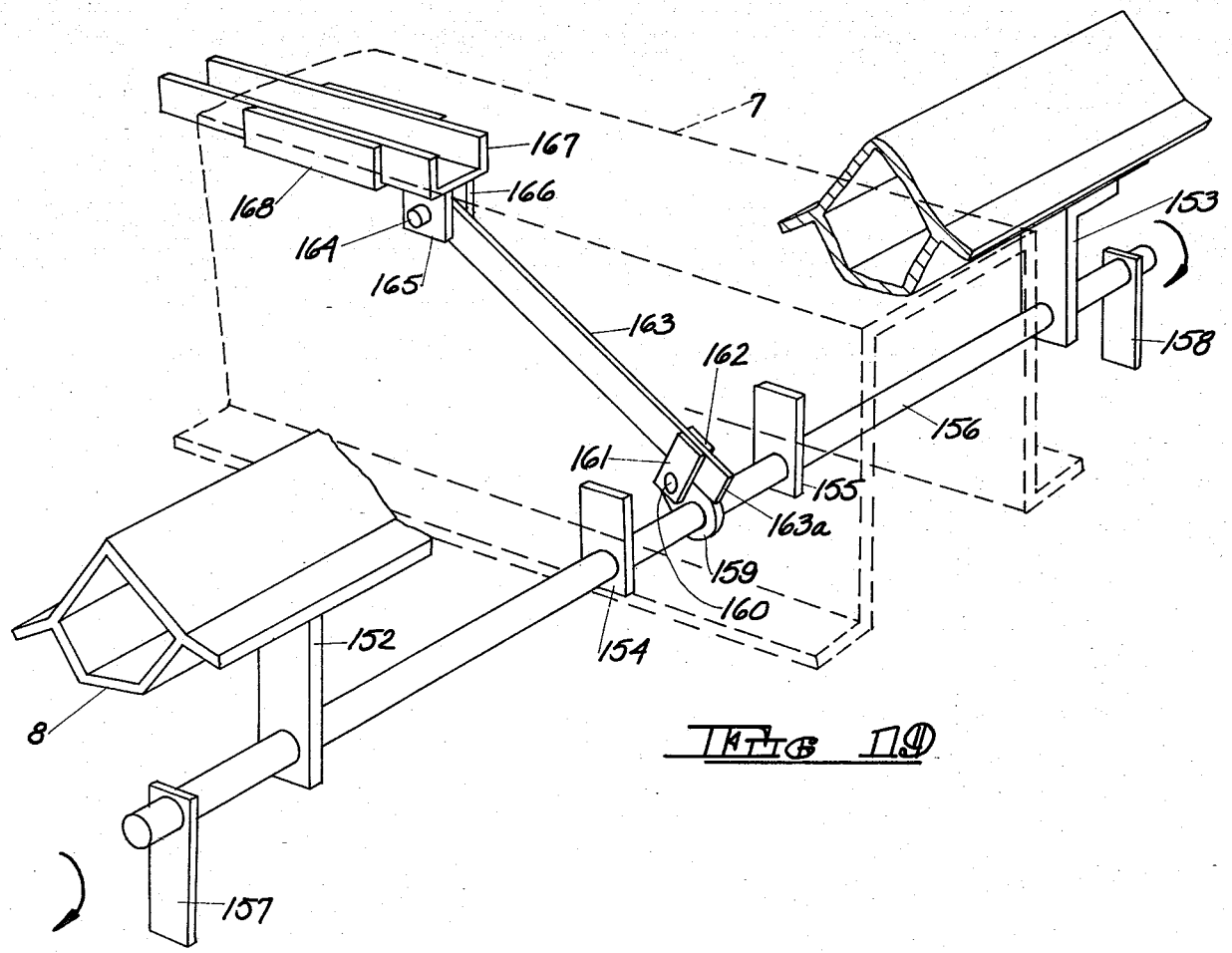
FIG. 19 is a fragmentary, semi-diagrammatic, perspective view of the door lock assembly of FIG. 17.

Referring to FIG. 17 and FIGS. 18 and 19, in which like parts have been given like index numerals, the transverse brace member 8 has affixed thereto, near its outermost ends, a pair of downwardly depending braces 152 and 153. In alignment therewith, the center sill 7 also has a pair of downwardly depending braces 154 and 155. The braces 152 through 155 are provided with coaxial perforations in which a shaft 156 is rotatively mounted. The shaft 156 is so sized that its ends are located adjacent the hopper car sides within easy reach of a workman. The ends of shaft 156 have handle elements 157 and 158 non-rotatively affixed thereto. Beneath center sill 7, the shaft 156 carries a lever 159 non-rotatively mounted thereon. The forward end of lever 159 is affixed by pivot pin 160 between a pair of downwardly depending lugs 161 and 162 affixed to an elongated link 163 near one of its ends **163*a*. The other end 163*b* of link 163 is located between and pivotally attached by pivot pin 164 to a pair of lugs 165 and 166 in parallel spaced relationship. The lugs 165 and 166 are mounted on an elongated channel member 167 which is slidably received in a U-shaped bracket 168 welded or otherwise affixed to the underside of the top of center sill 7**.

FIG. 17 illustrates the locking mechanism in its locking condition. The channel member 167, in its extended locking position, is of such width as to overlie the link 114 of lever structure 77. It will be evident from FIG. 17 that the lever structure 77 is illustrated in its door-closed position and is precluded from rotating in a counter clockwise direction (as viewed in FIG. 17) to its door-open position by virtue of the abutment of link 114 against channel member 167. It will be noted from FIG. 17 that the locking position of channel member 167 is determined by the abutment of the rearward end **163*a* of link 163 against the lever 159. It will further be noted that pivot pin 160 lies in an over-center position below an imaginary line drawn between pivot pin 164 and shaft 156. To release the lever structure 77, it is only necessary for a single workman to rotate handle 157 or handle 158 in a clockwise direction as viewed in FIG. 20. This will cause clockwise rotation of shaft 156 and lever 159 (as viewed in FIG. 20). The shaft 156 and lever 159 can be rotated until the link 163 abuts the lever 159. This is illustrated in FIG. 20**.

The above described rotation of lever 159 will result in a shifting of channel member 167 within U-shaped bracket 168 to its unlocked position, by virtue of the connection between channel member 167 and lever 159 by link 163. When the locking mechanism of FIGS. 17 through 20 is in the position illustrated in FIG. 20, the lever structure 77 is free to rotate to its door-open position.

Figure 20:
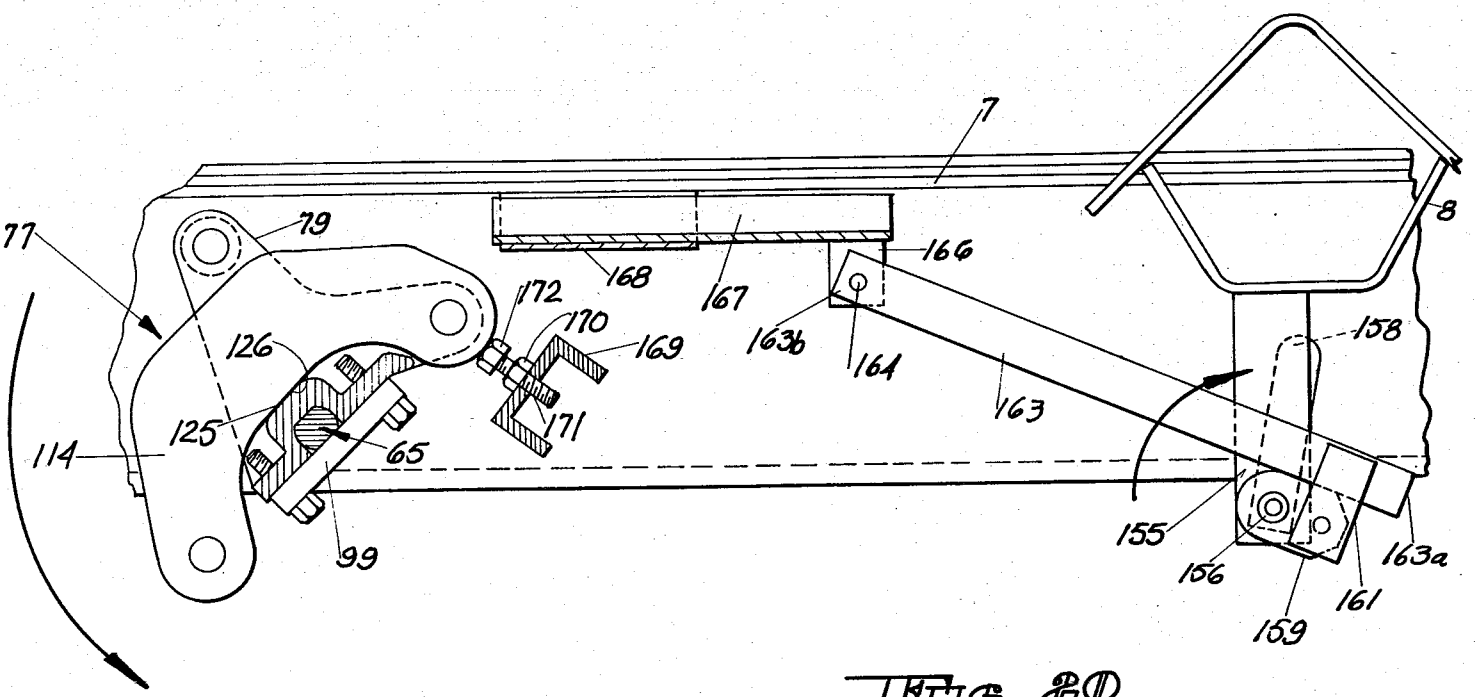
FIG. 20 is a fragmentary view, partly in cross section, similar to FIG. 17 and illustrating the door lock assembly in unlocked position.

When the lever structure 77 is returned to its door closed position, the locking mechanism of FIGS. 17 through 20 can be returned to its locking position as illustrated in FIG. 17, by simply rotating one or the other of handles 157 and 158 in such a fashion as to impart counter clockwise rotation to shaft 156 and lever 159 (as viewed in FIG. 20). This will result in a return of the locking mechanism to the position illustrated in FIG. 17.

It will be noted from FIG. 20 that, when the locking mechanism is in its unlocking position, the pivot pin 160 is located in an over-center position above the imaginary line drawn between shaft 156 and pivot pin 164. As a result, the locking mechanism of FIGS. 17 through 20 has an over-center position both in its locking and in its unlocking conditions. Handle elements 157 and 158 can be appropriately colored and serve as visual indicators showing whether or not the hopper doors are locked.

If the hopper doors are shifted from their open toward their closed positions, they cannot be closed unless the manual lock of FIGS. 17 through 20 is in its unlocked position. If the manual lock is only partially shifted to its locking position (i.e., not having been shifted over-center), the doors themselves, as they close, will shift the manual lock to its open position by contact of channel member 167 by link 114.

As indicated above, the over-center, closed positions of the shaft assembly 65 and lever structure 77 is determined by abutment of surface 125 on the intermediate spacer portion 80 of lever structure 77 and surface 126 of link 114. Under some circumstances, it is desirable that the over-center, closed positions of the shaft assembly 65 and lever structure 77 be adjustable. To this end, a separate stop means may be provided. Reference is again made to FIG. 20. In this Figure, a channel member 169 is illustrated, extending between and fixed to the inside vertical surfaces of center sill 7. The ends of channel member 169 may be affixed to center sill 7 in any appropriate manner such as welding or the like. A nut 170 is welded, or otherwise appropriately affixed, to channel member 169 and is coaxial with a perforation 171 in channel member 169. A bolt 172 is threadedly engaged in nut 170 and passes through channel perforation 171. It will be understood that rotation of bolt 172 will cause the bolt to shift axially with respect to channel 169 and nut 170. The bolt 172 is positioned so as to be abutted by the end of link 114. While the maximum over-center position will still be determined by abutment of surfaces 125 and 126, other over-center positions can be achieved by appropriate adjustment of bolt 172 so that link 114 abuts the head thereof.

Modifications may be made in the invention without departing from the spirit of it. For example, the ends of the shaft assembly 65 at either side of the hopper car could terminate in socket elements engagable by a hand-operated power tool adapted to impart rotation thereto. Such power tools are well known in the art and are frequently electrically or pneumatically powered. Similarly, the ends of the shaft assembly 65 could be provided with lever means so configured as to be actuable by railside tripping devices.

What is claimed is:

1. In a railroad hopper car of the type having a longitudinally extending center sill of substantially inverted U-shaped cross section and a plurality of hopper doors arranged in opposed pairs and extending transversely of said center sill, said hopper doors of each opposed pair being swingable between a downwardly depending open position and a closed position wherein their bottom edges meet in abutting relationship, each of said opposed pairs of hopper doors having a pair of inner hopper sheets and a pair of outer hopper sheets, the improvement comprising a door actuating means for each opposed pair of hopper doors to shift said doors between said open and closed positions from either side of the car, each door actuating means for each opposed pair of hopper doors comprising a rotatable shaft assembly extending transversely of said hopper car between its respective pair of opposed hopper doors and through said hopper car center sill and said inner and outer hopper sheets of said pair of hopper doors, said shaft assembly having a central portion located within said center sill, a lever structure non-rotatively mounted on said shaft center portion, said lever structure comprising a pair of substantially identical L-shaped lever portions in the same radial relationship with respect to said shaft center portion and in parallel spaced relationship with a spacer portion therebetween, each of said L-shaped lever portions having first and second legs, said first legs of said lever portions being connected to a first door of said pair by two V-shaped links pivotally attached at one end to said first door and pivotally attached at their other ends to their respective first leg, said second legs of said lever portions being connected to a second door of said pair by a single V-shaped link pivotally attached at one end to said second door and pivotally attached at its second end to and between said second legs, means on both ends of said shaft assembly by which either of said shaft assembly ends may be engaged by a rotation-imparting tool, said shaft assembly and said lever structure being rotatable between a first portion in which said pair of hopper doors are in said downwardly depending open position and a second position in which said pair of hopper doors are in said closed position and said lever structure and said links are in an over-center position with respect to said shaft assembly.

2. The structure claimed in claim 1 wherein said lever portions and spacer portion of said L-shaped lever structure comprise a single, one-piece casting.

3. The structure claimed in claim 1 including spring assist means to aid in shifting said doors of said pair from said open to said closed position.

4. The structure claimed in claim 1 including stop means to determine said hopper door-closed, over-center position of said lever structure.

5. The structure claimed in claim 1 including manually actuable locking means to lock said lever structure in said door-closed, over-center position.

6. The structure claimed in claim 1 wherein said pivotal attachment of said links to said legs is so located with respect to said legs as to cause said first and second hopper doors of said pair to pass over-center simultaneously as said hopper doors are shifted to said closed position.

7. The structure claimed in claim 1 wherein said pivotal attachment of said links to said legs is so located with respect to said legs as to cause said first hopper door to pass over-center before said second hopper door as said doors are shifted to said closed position.

8. The structure claimed in claim 1 including an actuating lever non-rotatively mounted on each of said shaft assembly ends exteriorly of said outer hopper sheets, each of said actuating levers having a portion extending laterally of its respective end of said shaft assembly, bracket means mounted on each side of said hopper car adjacent each of said actuating levers, each bracket means being so located that said lateral extension of said adjacent actuating lever is located within said bracket when said doors, said lever structure and said shaft assembly are in said door-closed positions, each of said actuating levers and its respective bracket being so configured to form a pocket for the receipt of the end of an elongated prying tool by which a prying force can be applied to said actuating lever to rotate said shaft assembly and lever structure to shift said hopper doors from their closed to their open positions.

9. The structure claimed in claim 1 including a pair of cylindrical extensions, each with one of its ends operatively and non-rotatively affixed to one of said shaft assembly ends exteriorly of said outer hopper sheets, each of said extensions having a free end provided with a diametrically opposed pair of identical notches each having a rectilinear working surface and an arcuate non-working surface so configured that an elongated prying tool can be inserted into said notches to rotate said shaft assembly only in a direction to rotate said lever structure and to shift said hopper doors to their door-closed positions.

10. The structure claimed in claim 4 wherein said stop means comprises a flat on said spacer portion of said lever structure and a flat on said single link, said flats being so positioned as to abut each other to determine said door-closed, over-center position of said lever structure.

11. The structure claimed in claim 4 wherein said stop means comprises a brace member extending transversely within said center sill, a bolt threadedly engaged in said brace member and being axially adjustable with respect thereto, said bolt means being so located as to abut said single link to determine said over-center position of said lever structure.

12. The structure claimed in claim 5 wherein said manually actuable locking means comprises a shaft rotatively mounted to said hopper car transversely thereof, said shaft having ends at either side of said hopper car, an operating handle affixed to each end of said shaft, a lever non-rotatively affixed to said shaft intermediate said ends thereof, said lever having a free end, an elongated link having first and second ends, means for pivotally attaching said free end of said lever to said first end of said elongated link, and elongated locking member, means for slidably mounting said locking member above said lever structure, means to pivotally attach said second end of said elongated link to said locking member, said locking member being shiftable longitudinally by means of said shaft, said lever and said elongated link between an extended locking position wherein said locking member overlies said single link of said lever structure to prevent rotation of said lever structure to said door-open position thereof and a retracted unlocking position wherein said locking member is remote from said single link of said lever structure.

13. The structure claimed in claim 8 including a pair of cylindrical extensions, each with one of its ends operatively and non-rotatively affixed to one of said shaft assembly ends exteriorly of said outer hopper sheets, each of said extensions having a free end provided with a diametrically opposed pair of identical notches each having a rectilinear working surface and an arcuate non-working surface so configured that an elongated prying tool can be inserted into said notches to rotate said shaft assembly only in a direction to rotate said lever structure and to shift said hopper doors to their door-closed positions.

14. The structure claimed in claim 13 including stop means to determine said hopper door-closed, over-center position of said lever structure.

15. The structure claimed in claim 14 including manually actuable locking means to lock said lever structure in said door-closed, over-center position.

16. The structure claimed in claim 14 wherein said stop means comprises a flat on said spacer portion of said lever structure and a flat on said single link, said flats being so positioned as to abut each other to determine said door-closed, over-center position of said lever structure.

17. The structure claimed in claim 14 wherein said stop means comprises a brace member extending transversely within said center sill, a bolt threadedly engaged in said brace member and being axially adjustable with respect thereto, said bolt means being so located as to abut said single link to determine said over-center position of said lever structure.

18. The structure claimed in claim 15 wherein said manually actuable locking means comprises a shaft rotatively mounted to said hopper car transversely thereof, said shaft having ends at either side of said hopper car, an operating handle affixed to each end of said shaft, a lever non-rotatively affixed to said shaft intermediate said ends thereof, said lever having a free end, an elongated link having first and second ends, means for pivotally attaching said free end of said lever to said first end of said elongated link, an elongated locking member, means for slidably mounting said locking member above said lever structure, means to pivotally attach said second end of said elongated link to said locking member, said locking member being shiftable longitudinally by means of said shaft, said lever and said elongated link between an extended locking position wherein said locking member overlies said single link of said lever structure to prevent rotation of said lever structure to said door-open position thereof and a retracted unlocking position wherein said locking member is remote from said single link of said lever structure.

19. In a railroad hopper car of the type having a longitudinally extending center sill of substantially inverted U-shaped cross section and a plurality of hopper doors arranged in opposed pairs and extending transversely of said center sill, said hopper doors of each opposed pair being swingable between a downwardly depending open position and a closed position wherein their bottom edges meet in abutting relationship, the improvement comprising door actuating means for each opposed pair of hopper doors to shift said doors between said open and closed positions, each door actuating means for each opposed pair of hopper doors comprising a rotatable shaft assembly extending transversely of said hopper car between its respective pair of opposed hopper doors, said shaft assembly being rotatively mounted in said center sill and having a central portion located within said center sill, a lever structure non-rotatively mounted on said shaft center portion, said lever structure comprising a pair of substantially identical L-shaped lever portions in the same radial relationship with respect to said shaft center portion and in parallel spaced relationship with a spacer portion therebetween, each of said L-shaped lever portions having first and second legs, said first legs of said lever portions being connected to a first door of said pair by two V-shaped links pivotally attached at one end to said first door and pivotally attached at their other ends to their respective first legs, said second legs of said lever portions being connected to a second door of said pair by a single V-shaped link pivotally attached at one end to said second door and pivotally attached at its second end to and between said second legs, said shaft assembly and said lever structure being rotatable between a first position in which said pair of hopper doors are in said downwardly depending open position and a second position in which said pair of hopper doors are in said closed position and said lever structure and said links are in an over-center position with respect to said shaft assembly.

* * * * *